US010477317B2

(12) United States Patent
Shimada et al.

(10) Patent No.: US 10,477,317 B2
(45) Date of Patent: Nov. 12, 2019

(54) SPEAKER STRUCTURE

(71) Applicant: Yamaha Corporation, Hamamatsu-shi, Shizuoka-Ken (JP)

(72) Inventors: Yumi Shimada, Hamamatsu (JP); Katsumasa Kosuge, Hamamatsu (JP); Hiroyuki Shibakusa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/229,743

(22) Filed: Dec. 21, 2018

(65) Prior Publication Data

US 2019/0200134 A1 Jun. 27, 2019

(30) Foreign Application Priority Data

Dec. 25, 2017 (JP) ..... 2017-247255

(51) Int. Cl.
*H04R 5/02* (2006.01)
*H04R 1/28* (2006.01)

(52) U.S. Cl.
CPC ..... *H04R 5/02* (2013.01); *H04R 1/2819* (2013.01)

(58) Field of Classification Search
CPC ..... H04R 5/02
See application file for complete search history.

(56) References Cited

U.S. PATENT DOCUMENTS 4,270,023 A * 5/1981 Beveridge ..... H04R 1/26 381/191
5,150,417 A * 9/1992 Stahl ..... H04R 1/2826 181/144
5,197,103 A * 3/1993 Hayakawa ..... H04R 1/02 181/148
5,602,367 A * 2/1997 Meyer ..... H04R 1/2819 181/145
5,892,183 A * 4/1999 Roozen ..... H04R 1/2826 181/156
6,019,188 A * 2/2000 Nevill ..... H04R 1/2826 181/156
8,256,566 B1 9/2012 Rodgers
9,635,454 B2 * 4/2017 Larrieu ..... H04R 1/2826
2006/0201739 A1 * 9/2006 Tanaami ..... H04R 1/2826 181/156
2009/0190784 A1 * 7/2009 Ong ..... H04R 1/2819 381/351

(Continued)

FOREIGN PATENT DOCUMENTS

JP 1-105296 U 7/1989
JP 11-178083 A 7/1999

OTHER PUBLICATIONS

Extended European Search Report issued in counterpart European Application No. 18214232.3 dated May 13, 2019 (six (6) pages).

*Primary Examiner* — Olisa Anwah
(74) *Attorney, Agent, or Firm* — Crowell & Moring LLP

(57) ABSTRACT

A speaker structure includes a first enclosure, a second enclosure, a partition plate and a bass reflex port. The partition plate has a communication hole that is provided between the first enclosure and the second enclosure and allows the first enclosure and the second enclosure to communicate with each other. The bass reflex port is disposed at least on either the first enclosure or the second enclosure.

19 Claims, 9 Drawing Sheets

(56) References Cited

U.S. PATENT DOCUMENTS

| | | | | |
|---|---|---|---|---|
| 2014/0193005 | A1* | 7/2014 | Riggs | H04R 5/02 381/300 |
| 2015/0086057 | A1* | 3/2015 | Christner | H04R 1/2819 381/349 |
| 2017/0295424 | A1* | 10/2017 | Yang | H04R 1/20 |
| 2017/0311075 | A1* | 10/2017 | Vaisanen | H04R 1/025 |

* cited by examiner

SPEAKER STRUCTURE

CROSS REFERENCE TO RELATED APPLICATIONS

This Nonprovisional application claims priority under 35 U.S.C. § 119(a) on Patent Applications No. 2017-247255 filed in Japan on Dec. 25, 2017 the entire contents of which are hereby incorporated by reference.

BACKGROUND OF THE INVENTION

1. Field of the Invention

A preferred embodiment of the present invention relates to a small-sized stereophonic speaker structure.

2. Description of the Related Art

Patent Literature 1 (Publication of Japanese Utility Model Application, Publication Number: JPH01105296 (U)) discloses a stereophonic speaker apparatus containing a right channel speaker and a left channel speaker in one cabinet.

The stereophonic speaker apparatus described in Patent Literature 1 is provided with an acoustic space portion between right and left enclosures. The stereophonic speaker apparatus described in Patent Literature 1 enhances low frequency components that are emitted from rear faces of the right channel speaker and the left channel speaker in the acoustic space portion, and thereby realizes a powerful stereophonic reproduction.

SUMMARY OF THE INVENTION

In the stereophonic speaker apparatus described in Patent Literature 1, the acoustic space portion to enhance the low frequency components is formed between the right and the left enclosures. For this reason, the speaker apparatus needs to have a wider width by a width of the acoustic space portion. Thus, in designing a small-sized speaker apparatus, the size of the acoustic space portion is subject to restriction.

In view of the foregoing, a preferred embodiment of the present invention is directed to provide a small-sized speaker structure capable of sufficiently reproducing low frequency components while separating high frequency components.

A speaker structure according to a preferred embodiment of the present invention includes a first enclosure, a second enclosure, a partition plate and a bass reflex port. The partition plate has a communication hole that is provided between the first enclosure and the second enclosure and allows the first enclosure and the second enclosure to communicate with each other. The bass reflex port is disposed at least on either the first enclosure or the second enclosure.

According to the present invention, in one aspect thereof, it is made possible to sufficiently reproduce low frequency components while separating high frequency components, without increasing a width of a housing.

The above and other elements, features, characteristics, and advantages of the present invention will become more apparent from the following detailed description of the preferred embodiments with reference to the attached drawings.

DESCRIPTION OF THE PREFERRED EMBODIMENTS

Figure 1:
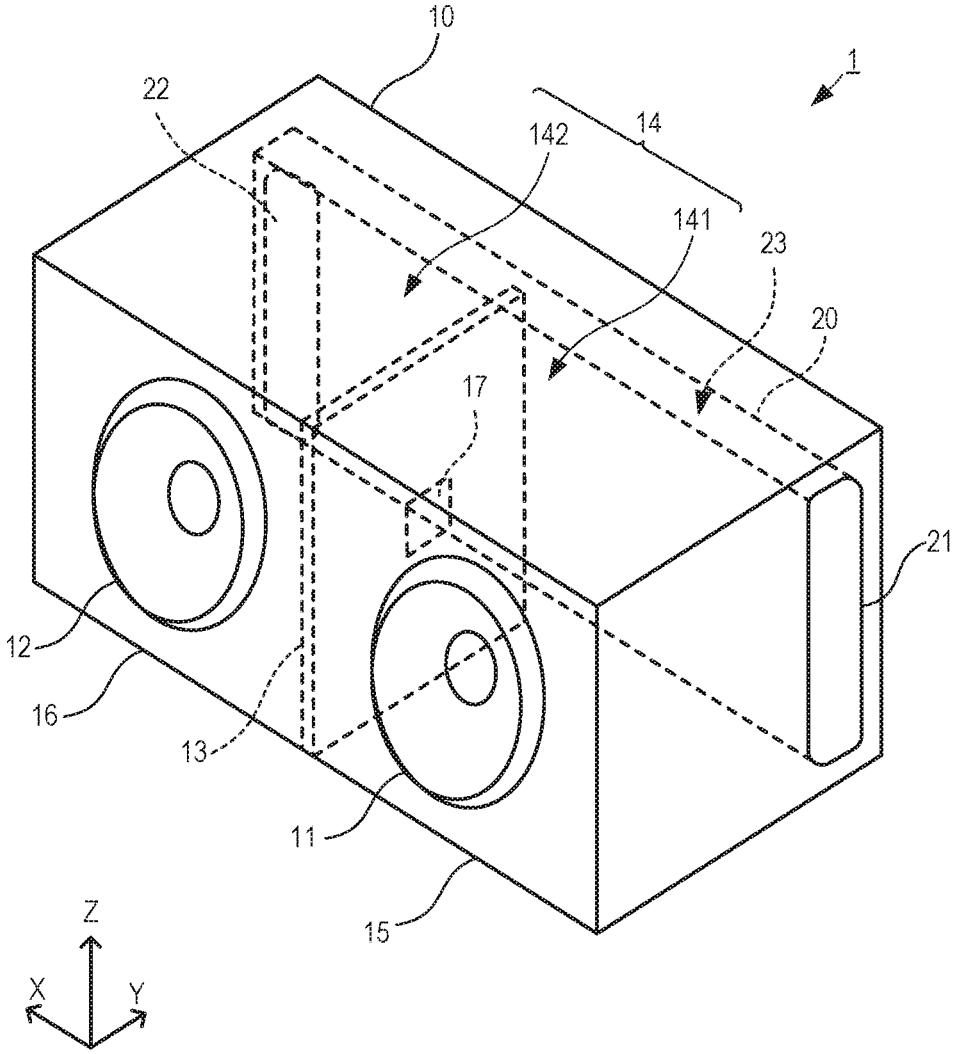
FIG. 1 is a perspective view to explain a speaker structure according to a first embodiment of the present invention.
Figure 2A:
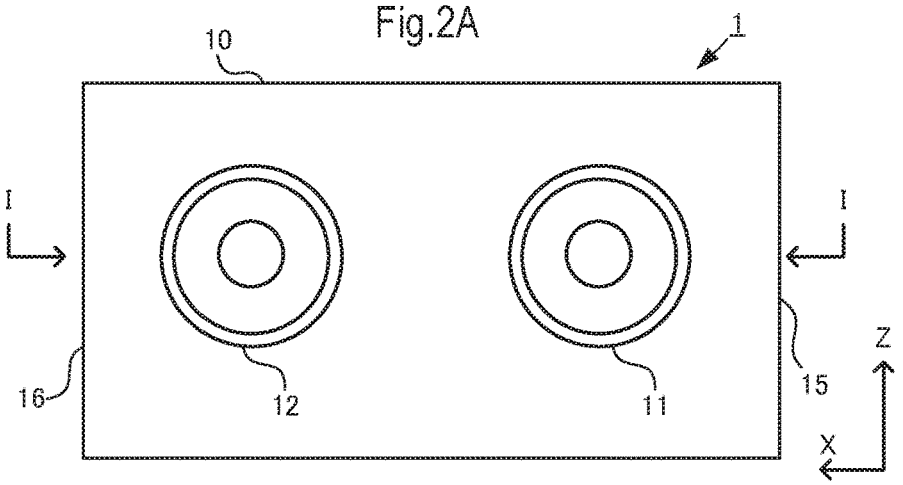
FIG. 2A is a front view of the speaker structure according to the first embodiment.
Figure 2B:
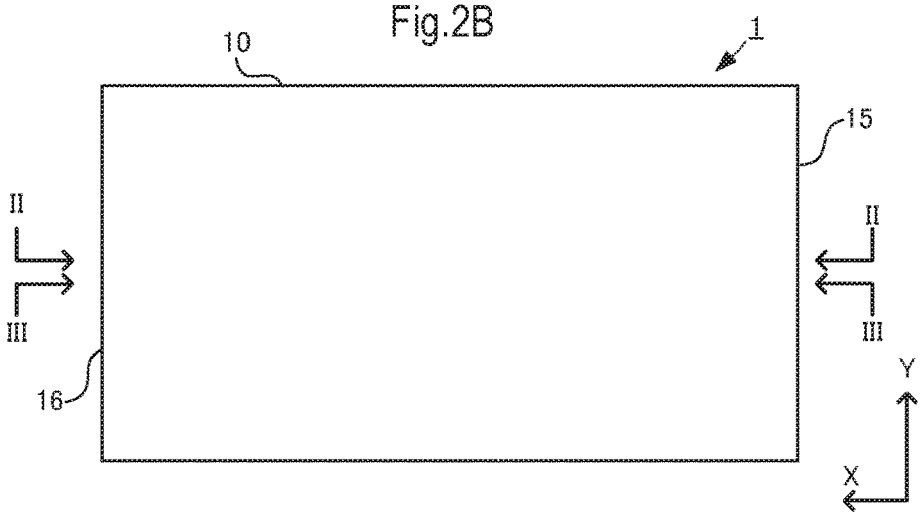
FIG. 2B is a plan view of the speaker structure according to the first embodiment.
Figure 2C:
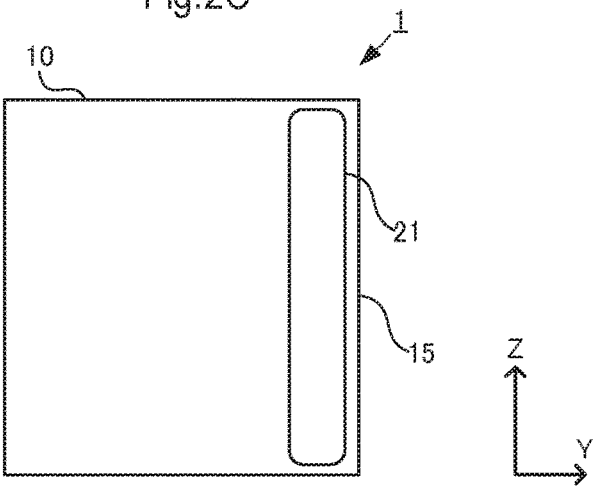
FIG. 2C is aright side view of the speaker structure according to the first embodiment.
Figure 3A:
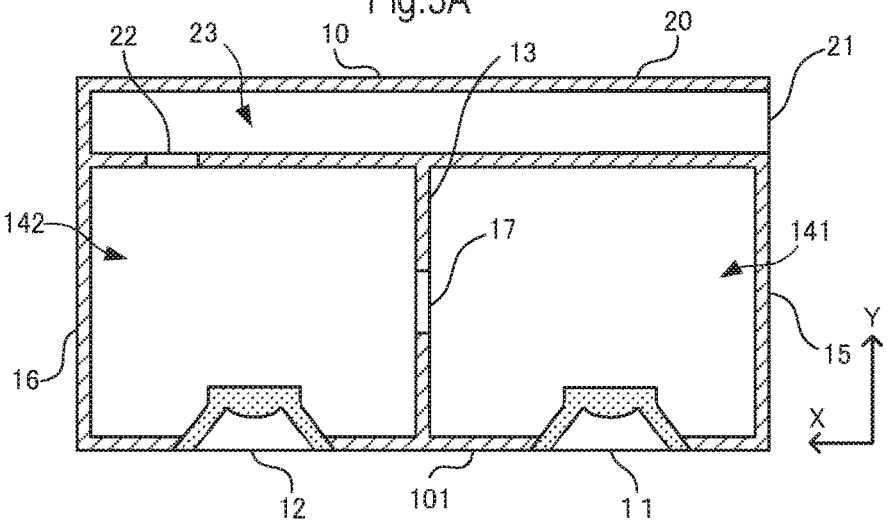
FIG. 3A is a cross-sectional view of the speaker structure according to the first embodiment.
Figure 3B:
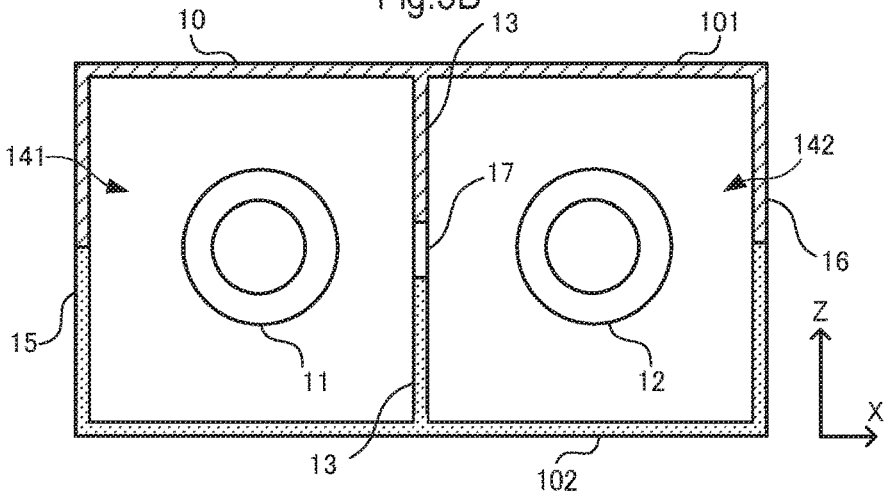
FIG. 3B is a cross-sectional view of the speaker structure according to the first embodiment.
Figure 3C:
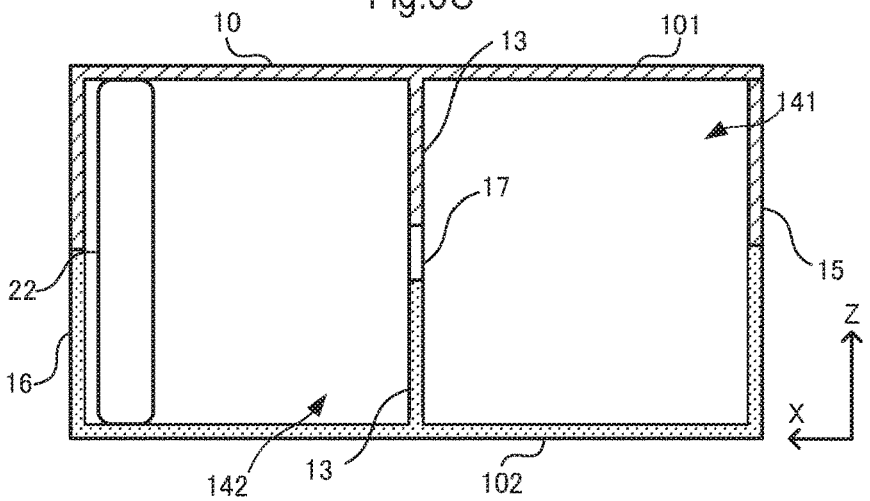
FIG. 3C is a cross-sectional view of the speaker structure according to the first embodiment.
Figure 4A:
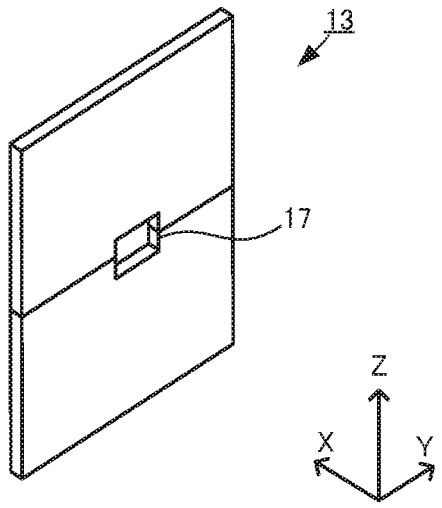
FIG. 4A is a perspective view showing a partition plate according to the first embodiment.
Figure 4B:
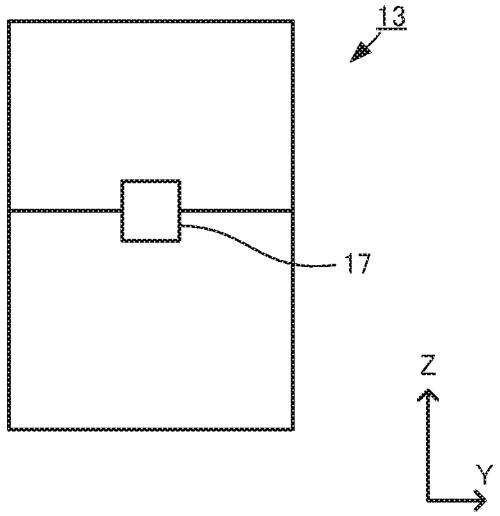
FIG. 4B is a right side view of the partition plate according to the first embodiment.

FIG. 1 is a perspective view to explain a speaker structure according to a first embodiment of the present invention. FIG. 2A is a front view of the speaker structure according to the first embodiment. FIG. 2B is a plan view of the speaker structure according to the first embodiment. FIG. 2C is a right side view of the speaker structure according to the first embodiment. FIG. 3A is a cross-sectional view of the speaker structure according to the first embodiment that is cut at line I-I of FIG. 2A. FIG. 3B is a cross-sectional view of the speaker structure according to the first embodiment that is cut at line II-II of FIG. 2B, and FIG. 3C is a cross-sectional view of the speaker structure according to the first embodiment that is cut at line of FIG. 2B. FIG. 4A is a perspective view showing a partition plate according to the first embodiment. FIG. 4B is a right side view of the partition plate according to the first embodiment. Additionally, in FIG. 1, for the convenience of explanation, only the port and the partition plate that are located inside are shown by broken lines, whereas other internal components are omitted. Also, hereinafter, explanation is to be made defining a width direction (lateral direction) of a housing as X-direction, a front-rear direction (depth direction) thereof as Y-direction, and a thickness direction (height direction) as Z-direction.

As shown in FIG. 1, FIG. 2A, FIG. 2B and FIG. 2C, a speaker structure 1 includes a housing 10, a right channel speaker 11, and a left channel speaker 12. The speaker structure 1 includes, inside the housing 10, a port 20 and a partition plate 13. The port 20 is located, inside the housing 10, on an opposite side of where the right channel speaker 11 and the left channel speaker 12 are disposed, that is, on a rear face side. A first opening portion 21 of the port 20 is open to outside in a side face of the housing 10. This ensures that the first opening portion 21 is formed at a position that is difficult to be viewed by users. This permits an increased degree of freedom in designing the speaker structure 1. Also, the placement of the port 20 is not limited to the rear face side of an interior of the housing 10. For example, the port 20 may be disposed on a top face side or a bottom face side of the interior of the housing 10.

In the speaker structure 1, a space to a side of the speaker 11 and the speaker 12 from the port 20 forms an acoustic space 14. The acoustic space 14 is divided by the partition plate 13 into a first space 141 on the speaker 11 side and a second space 142 on the speaker 12 side. The first space 141 is a first enclosure 15 in which the speaker 11 is installed. The second space 142 is a second enclosure 16 in which the speaker 12 is installed. That is, the partition plate 13 is provided between the first enclosure 15 and the second enclosure 16.

As shown in FIG. 3A, FIG. 3B, FIG. 3C, FIG. 4A and FIG. 4B, the partition plate 13 has a communication hole 17. The communication hole 17 allows the first enclosure 15 and the second enclosure 16 to communicate with each other.

The partition plate 13 separates middle and high frequency components out of sounds emitted from rear faces of the speaker 11 and the speaker 12. The middle and high frequency components out of the sounds emitted from the rear faces of the speaker 11 and the speaker 12 have smaller pressure changes inside the first enclosure 15 and the second enclosure 16 as compared to the low frequency components. For this reason, the middle and high frequency components are separated between the first space 141 and the second space 142, and this results in an increased separation feeling between the right and left sounds. The speaker 11 and the speaker 12 emit sounds containing the middle and high frequency components that depend on respective channels. This makes it possible for the speaker structure 1 to provide users with a feeling of presence.

The low frequency components out of the sounds emitted from the rear faces of the speaker 11 and the speaker 12 have larger pressure changes inside the first enclosure 15 and the second enclosure 16 as compared to the middle and high frequency components. This allows the oscillation of the low frequency components to propagate between the first space 141 and the second space 142 each other through the communication hole 17. In other words, the communication hole 17 functions as a low-pass filter. Therefore, for the low frequency components out of the sounds emitted from the rear faces of the speaker 11 and the speaker 12, the whole acoustic space 14 functions as one enclosed space. The acoustic space 14 has a larger volume as compared with the first enclosure 15 or the second enclosure 16. Thus, it is less likely that the acoustic space 14 interferes with the oscillation of the low frequency components. Besides, the low frequency components have low directivity. For this reason, in the case of the low frequency components out of the sounds emitted from the rear faces of the speaker 11 and the speaker 12, the separation feeling between the right and left is not a matter of importance; instead, the voluminousness of the bass can be increased.

It is preferable that the communication hole 17 is formed in a middle of the partition plate 13, as shown in FIG. 4A and FIG. 4B. This permits the oscillation of the low frequency components to easily propagate between the first space 141 and the second space 142 each other through the communication hole 17. In contrast, if the communication hole 17 is formed at a position too far to one side in the partition plate 13, there arises a bias in distance between the communication hole 17 and an inner wall of the first enclosure 15 or the second enclosure 16. Therefore, in the acoustic space 14, there arises a bias in the propagation of the oscillation of the low frequency components. On the other hand, by changing the position of the communication hole 17 in the partition plate 17, it is possible to reproduce a sound depending on users preferences, or kinds of sound to reproduce and so forth.

It is also possible to change the quality of sound to reproduce by a size of the communication hole 17. For example, when a cross-section of the communication hole 17 is large, the oscillations of the frequency components of not only the low frequency components but also the middle frequency components can easily propagate between the first space 141 and the second space 142 each other. This can help increase the voluminousness of the middle frequency components.

In the speaker structure 1, the first enclosure 15, the second enclosure 16 and the partition plate 13 have apart formed integrally. For example, as shown in FIG. 3B and FIG. 3C, the housing 10 consists of an upper cover 101 and a lower cabinet 102. The communication hole 17 may be a gap formed by the upper cover 101 and the lower cabinet 102 in between thereof. In this manner, since the first enclosure 15, the second enclosure 16 and the partition plate 13 are composed of two members for the first enclosure 15, the second enclosure 16 and the partition plate 17, their production process is simplified.

The port 20 has the first opening portion 21 that is open to outside, and a second opening portion 22 that is disposed on the second enclosure 16. The second opening portion 22 corresponds to an "opening portion" of the present invention. Also, the port 20 corresponds to a "bass reflex port".

The port 20 is communicatively connected to the acoustic space 14 through the second opening portion 22, and communicatively connected to outside through the first opening portion 21. The second opening portion 22 of the port 20 may be disposed on either the first enclosure 15 or the second enclosure 16. The second opening portion 22 is provided, in the second enclosure 16, on an opposite side of where the speaker 12 is disposed, that is to say, on a rear face side of the second enclosure 16.

The resonance of sound in the port 20 depends on a shape of an internal space 23 of the port 20. The resonance frequency f of the port 20 depends on a cross-sectional area of the port 20, or a length of the port 20.

It is preferable that the port 20 is one. As in this embodiment, forming one port over the first enclosure 15 and the second enclosure 16 makes it possible to design the port 20 to have a length that spans the width of the housing 10. Therefore, even in a relatively small-sized speaker structure 1, because the cross-sectional area of the port 20 can be designed large, it is possible to suppress the occurrence of wind noise.

As shown in FIG. 3A, the port 20 is formed in such a manner as to be located on the rear face of the first enclosure 15 and the second enclosure 16. That is, an axis of the port 20 extends along a direction (X-direction) in which the first enclosure 15 and the second enclosure 16 are arranged in a row. This allows the port 20 to be formed with a large length, which in turn makes it possible to keep the resonance frequency f low and thus to sufficiently enhance the low frequency components.

Figure 5A:
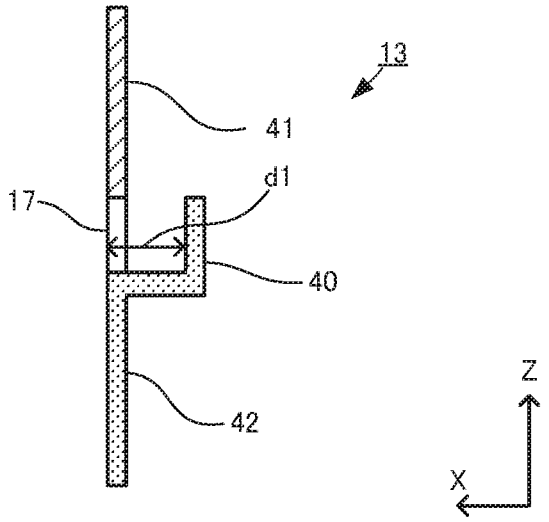
FIG. 5A is a cross-sectional view showing a modification example of the partition plate according to the first embodiment.
Figure 5B:
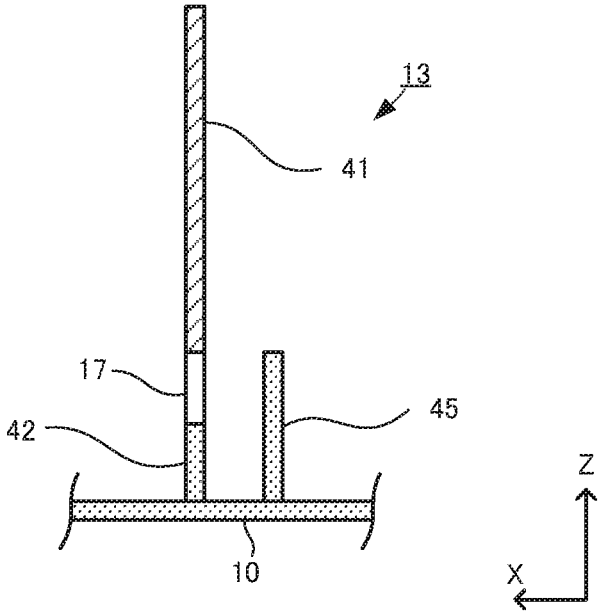
FIG. 5B is a cross-sectional view showing another modification example of the partition plate according to the first embodiment.

FIG. 5A and FIG. 5B are cross-sectional views showing modification examples of the partition plate according to the first embodiment. The modification examples of the partition plate according to the first embodiment are explained below.

As shown in FIG. 5A, the partition plate 13 consists of an upper partition plate 41 and a lower partition plate 42. The communication hole 17 is formed by the upper partition plate 41 and the lower partition plate 42. The lower partition plate 42 is provided with a wall 40 that faces the communication hole 17. The wall 40 protrudes on a side of the first enclosure 15 so as to face the communication hole 17.

With the partition plate 13 provided with the wall 40, it becomes hard for the middle and high frequency components to diffract the communication hole 17. The middle and high frequency components out of the sounds emitted from the rear faces of the speaker 11 and the speaker 12, because of their small pressure changes as well as high directivity, become hard to diffract the communication hole 17 that is provided with an obstacle. In contrast, the low frequency components out of the sounds emitted from the rear faces of the speaker 11 and the speaker 12, because of their large pressure changes as well as low directivity, pass through the communication hole 17 diffracting the obstacle. This permits the middle and high frequency components to be separated more easily between the first space 141 and the second space 142 from each other. And this results in an improved separation feeling between the right and left sounds.

In another modification example shown in FIG. 5B, the partition plate 13 consists of an upper partition plate 41 and a lower partition plate 42. The communication hole 17 is formed by the upper partition plate 41 and the lower partition plate 42. Also, a wall 45 is formed on the housing 10. The wall 45 faces the communication hole 17. In this configuration, the wall 45 only needs to face the communication hole 17; and thus, for example, the wall 45 may be any one as long as it is formed in a rectangular parallelepiped shape. Further, the wall 45 and the partition plate 42 may be formed integrally together with the housing 10. In this case, because of such a simplified structure of the wall 45, production thereof becomes easy.

The wall 45 is installed in such a manner as to protrude from the partition plate 13 toward the first enclosure 15 so as to face the communication hole 17. Therefore, in the same manner as in the modification example shown in FIG. 5A, it become hard for the middle and high frequency components, which have small pressure changes as well as high directivity, to diffract the communication hole 17. This permits the middle and high frequency components to be separated more easily between the first space 141 and the second space 142 from each other. And this results in an improved separation feeling between the right and left sounds.

Additionally, in the modification examples shown in FIG. 5A and FIG. 5B, the wall 40 and the wall 45 may protrude on the side of at least either the first enclosure 15 or the second enclosure 16. No matter which direction the wall 40 and the wall 45 may be installed in such a manner as to protrude toward, the same effect is obtained.

If the position of the wall 40 or the wall 45 changes, the quality of sound to reproduce changes. For example, when a length d1 shown in FIG. 5A is long, as compared with a case where the length of d1 is short, it becomes easier for the oscillation of the low frequency components to propagate between the first space 141 and the second space 142 each other. The d1 shows a distance from the communication hole 17 to a wall face of the wall 40 on a side of the communication hole 17. This helps increase the voluminousness of the low frequency components.

On the other hand, when the length d1 is short, it becomes harder for the oscillation of the middle and high frequency components to propagate between the first space 141 and the second space 142 each other. This results in an improved separation feeling between reproduced sounds.

Figure 6A:
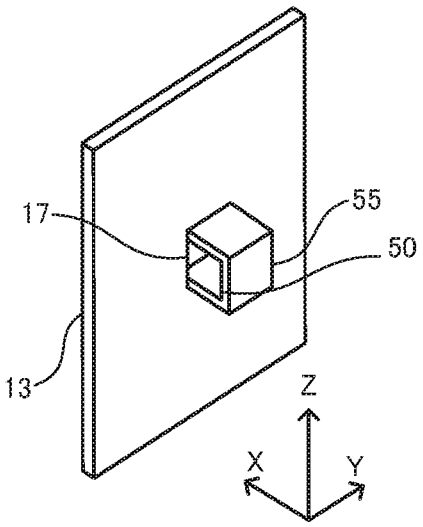
FIG. 6A is a perspective view showing a partition plate according to a second embodiment of the present invention.
Figure 6B:
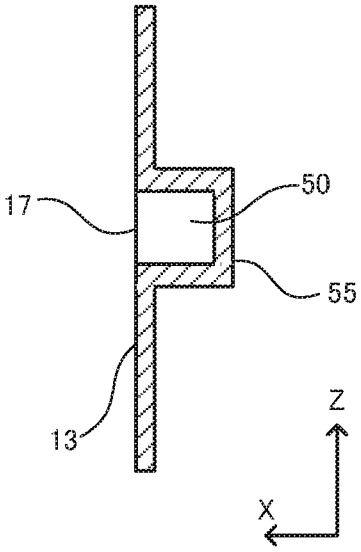
FIG. 6B is a cross-sectional view of the partition plate according to the second embodiment.
Figure 6C:
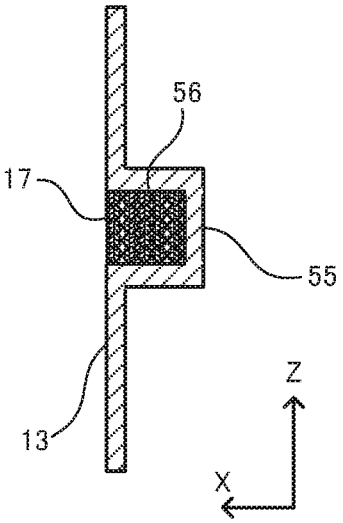
FIG. 6C is another cross-sectional view of the partition plate according to the second embodiment.
Figure 6D:
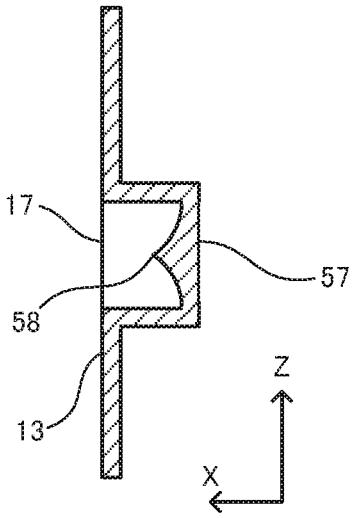
FIG. 6D is still another cross-sectional view of the partition plate according to the second embodiment.

FIG. 6A is a perspective view showing a partition plate according to a second embodiment of the present invention. FIG. 6B, FIG. 6C and FIG. 6D are cross-sectional views of the partition plate according to the second embodiment. Subsequently, the modification examples of the partition plate according to the second embodiment are explained. In the second embodiment, descriptions of configurations similar to those of the partition plate according to the first embodiment will be omitted.

As shown in FIG. 6A and FIG. 6B, the partition plate 13 is composed of a single member. The partition plate 13 is formed as part of the upper cover 101 or the lower cabinet 102. In the partition plate 13, a communication hole 17 that allows the first space 141 and the second space 142 to communicate with each other is formed. The partition plate 13 is provided with a wall 55 that faces the communication hole 17. The wall 55 is formed in such a manner as to protrude from the partition plate 13 toward the first enclosure 15 so as to face the communication hole 17.

The oscillation of the low frequency components propagates between the first space 141 and the second space 142 each other through a communication hole 50 that is formed along X-Z plane by the communication hole 17 and the wall 55. With the partition plate 13 provided with the wall 55, it becomes hard for the oscillation of the middle and high frequency components to propagate between the first space 141 and the second space 142 each other.

Further, the wall 55 is formed integrally with the partition plate 13. By changing the structure of the partition plate wall 55, it is possible to adjust the quality of sound to reproduce from the speaker structure 1.

Also, as shown in FIG. 6C, a sound absorbing material 56 may be provided between the partition plate 13 and the wall 55. With the sound absorbing material 56, because it further interferes with diffraction of the middle and high frequency components through the communication hole 17, it becomes more difficult for the oscillation of the middle and high frequency components to propagate between the first space 141 and the second space 142 each other. This results in an improved separation feeling between the reproduced sounds.

Moreover, as shown in FIG. 6D, the partition plate 13 may be provided with a wall 57. The wall 57 has a face 58 that is crooked and faces the communication hole 17. With the face 58 having a protruding obstacle, it becomes more difficult for the oscillation of the middle and high frequency components that have high directivity to propagate between the first space 141 and the second space 142 each other. Thus, the separation feeling between the reproduced sounds is improved.

FIG. 7A, FIG. 7B, FIG. 7C and FIG. 7D are views showing modification examples of the communication hole 17.

Figure 7A:
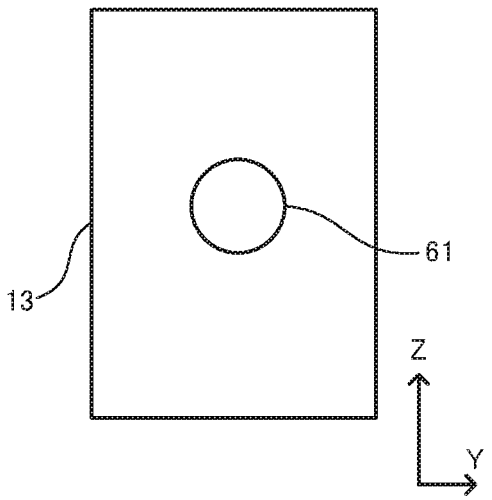
FIG. 7A is a view showing a modification example of the communication hole.

As shown in FIG. 7A, a shape of a communication hole 61 may be formed in a circle. For example, when the housing has a cylindrical shape, the partition plate 13 is formed in a disk shape. In this case, the communication hole 61 can be disposed in a middle of the partition plate 13.

Figure 7B:
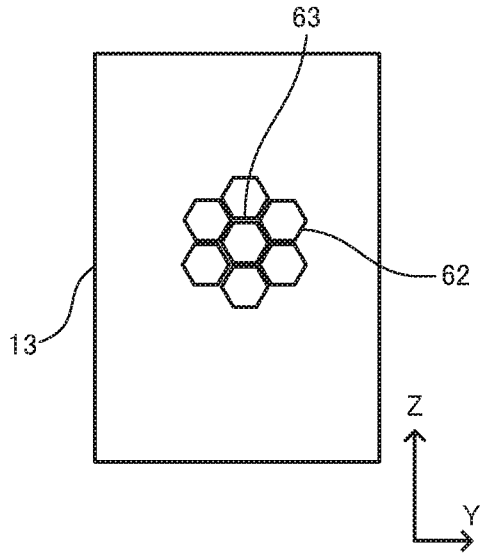
FIG. 7B is a view showing another modification example of the communication hole.

As shown in FIG. 7B, a shape of a communication hole 62 may be formed in a polygon. Further, the communication hole 62 may be formed more than one. By forming the communication hole 62 more than one and devising how to arrange the respective communication hole 62, so that it is possible to correspond to the usage mode of various users.

For example, as shown in FIG. 7B, in a case where a plurality of the communication holes 62 in a hexagonal shape are arranged close to each other, a bridging portion 63 is formed in between the communication holes 62. In this case, it becomes difficult for the oscillation of the middle and high frequency components having small pressure changes and high directivity are easily affected by the bridging portion 63, to propagate between the first space 141 and the second space 142 each other. Thus, the separation feeling between the reproduced sounds is improved by the partition plate 13.

Figure 7C:
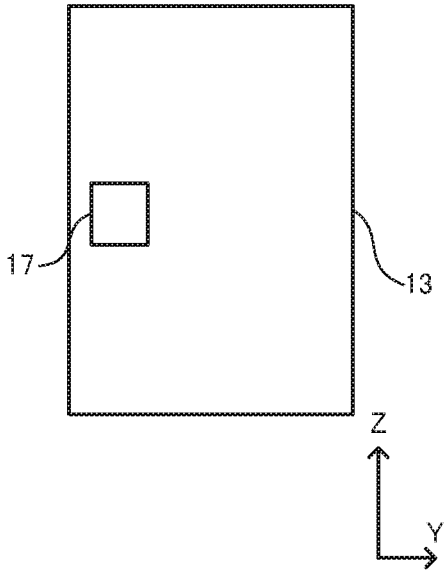
FIG. 7C is a view showing still another modification example of the communication hole.
Figure 7D:
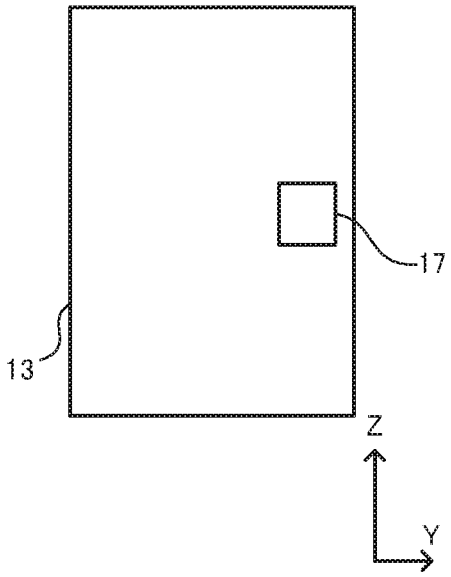
FIG. 7D is a view showing yet still another modification example of the communication hole.

The communication hole 17 may be disposed either on a front face side of the speaker structure as shown in FIG. 7C, or on the rear face side of the speaker structure as shown in FIG. 7D.

In the case where the communication hole 17 is disposed on the front face side of the speaker structure 1, the communication hole 17 becomes close to the speaker 11 and the speaker 12. The sounds emitted from the speaker 11 and the speaker 12 reach the communication hole 17 directly without being attenuated. This permits the oscillation of the low frequency components to easily propagate between the first space 141 and the second space 142 each other. And this helps increase the voluminousness of the low frequency components.

In the case where the communication hole 17 is disposed on the rear face side of the speaker structure 1, the communication hole 17 becomes far from the speaker 11 and the speaker 12. The sounds emitted from the speaker 11 and the speaker 12 reach the communication hole 17 in an attenuated manner. Therefore, the oscillation of the low frequency components is caused to propagate between the first space 141 and the second space 142 each other in a state of being attenuated. This can help reduce the voluminousness of the low frequency components. Thus, the voluminousness of the low frequency components can be adjusted by the position of the communication hole 17.

Figure 8A:
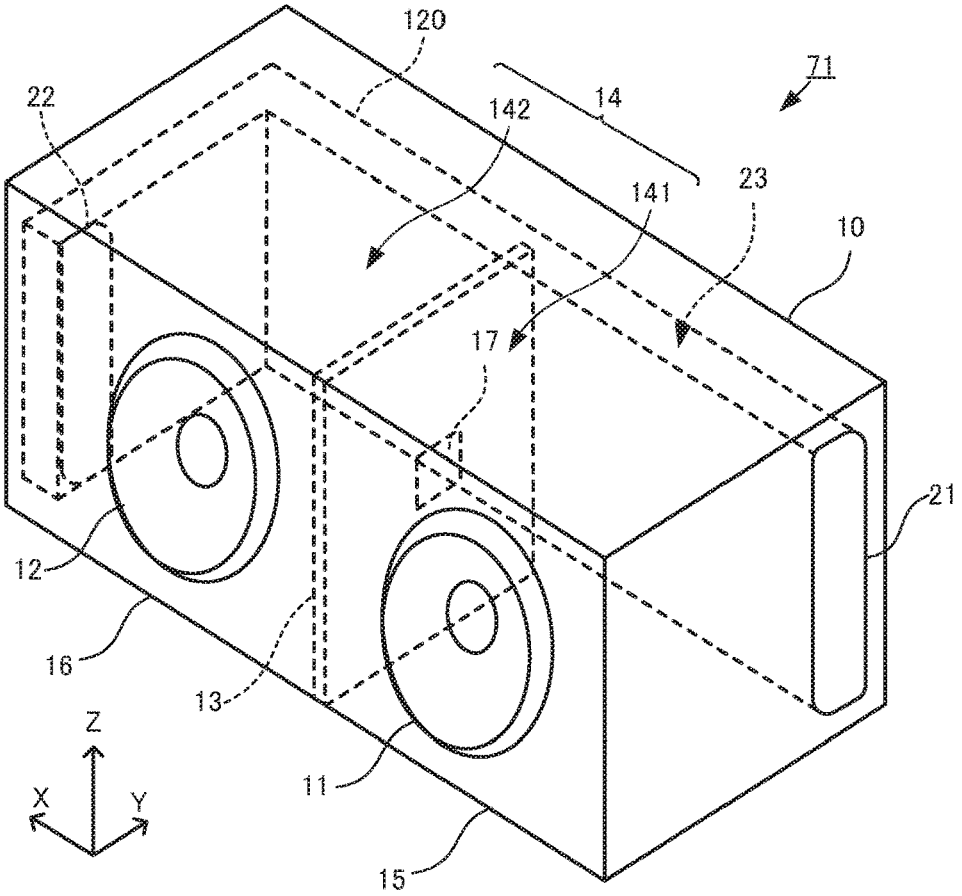
FIG. 8A is a perspective view showing a speaker structure according to a third embodiment of the present invention.
Figure 8B:
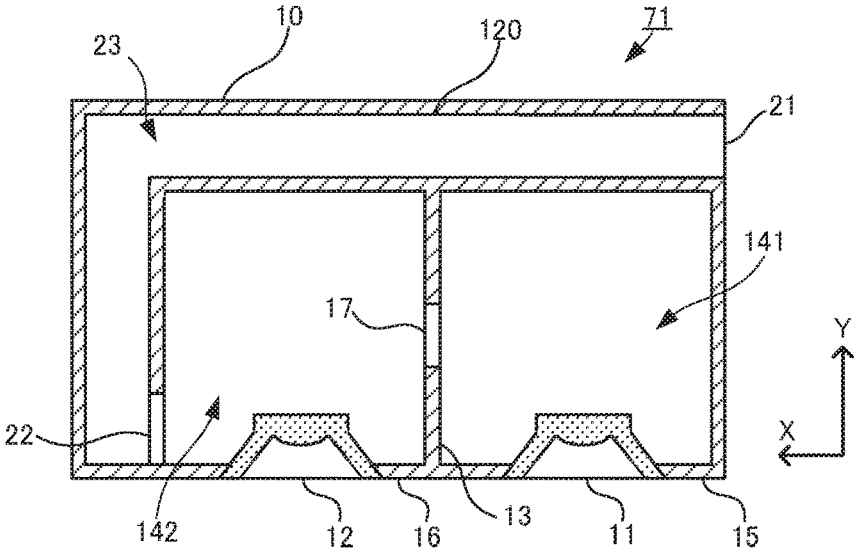
FIG. 8B is a cross-sectional view of the speaker structure according to the third embodiment.

FIG. 8A is a perspective view showing a speaker structure according to a third embodiment of the present invention. FIG. 8B is a cross-sectional view of the speaker structure according to the third embodiment. In the third embodiment, descriptions of configurations similar to those of the speaker structure according to the speaker structure 1 of the first embodiment will be omitted.

As shown in FIG. 8A and FIG. 8B, a speaker structure 71 according to the third embodiment has a port 120. The port 120 has a different shape from the port 20 of the speaker structure 1. The port 120 has a shape bent in L-shape.

An opening portion 22 of the port 120 is provided in a side face of the second enclosure 16 on an opposite side of the partition plate 13. Therefore, with the port 120, a distance between the first opening portion 21 and the second opening portion 22 becomes longer. This allows the port 120 to have a larger length, which in turn makes it possible to keep the resonance frequency f lower and thus to sufficiently reproduce the low frequency components.

Figure 9A:
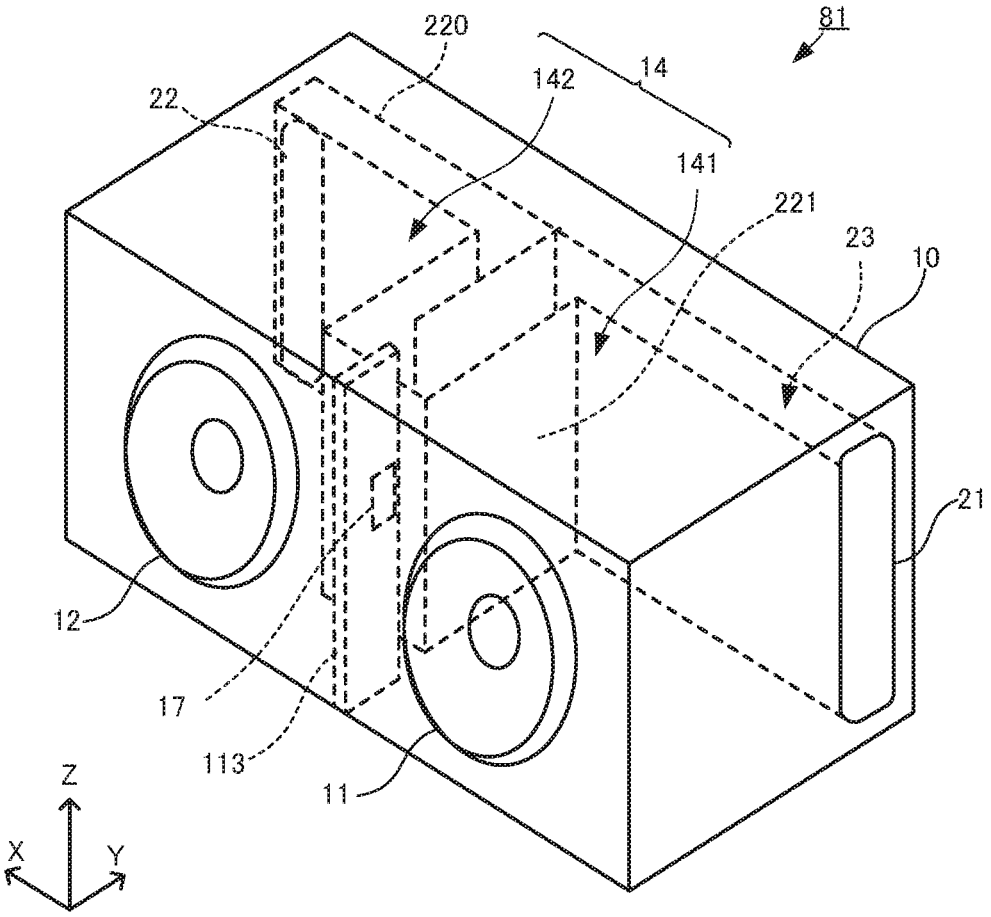
FIG. 9A is a perspective view showing a speaker structure according to a fourth embodiment of the present invention.
Figure 9B:
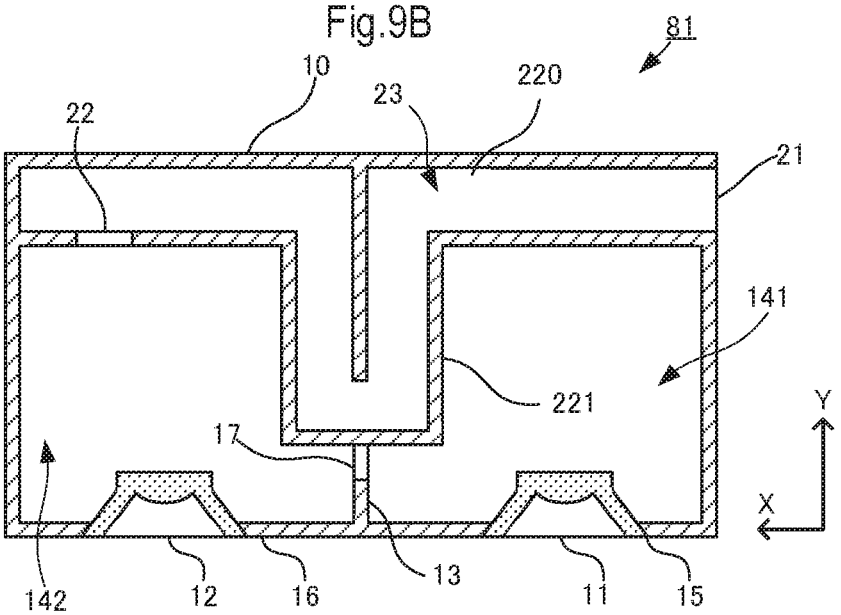
FIG. 9B is a cross-sectional view of the speaker structure according to the fourth embodiment.

FIG. 9A is a perspective view showing a speaker structure according to a fourth embodiment of the present invention. FIG. 9B is a cross-sectional view of the speaker structure according to the fourth embodiment. In the fourth embodiment, descriptions of configurations similar to those of the speaker structure according to the speaker structure 1 of the first embodiment will be omitted.

As shown in FIG. 9A and FIG. 9B, a speaker structure 81 according to the fourth embodiment has a port 220. The port 220 has a different shape from the port 20 of the speaker structure 1. The port 220 has, near a middle thereof in X direction, a protrusion portion 221 that is bent in such a manner as to protrude toward a side of the speaker 11 and the speaker 12.

Part of the port 220 is bent in such a manner as to protrude from a rear face side to a front face side of the speaker structure 81, that is, along a direction of Y-axis. Therefore, it is possible to form the port 220 longer as compared with linearly formed ports. This in turn makes it possible to keep the resonance frequency f lower and thus to sufficiently reproduce the low frequency components.

Besides, the protrusion portion 221, together with a partition plate 113, separates the acoustic space 14 into a first space 141 and a second space 142. As a result, the partition plate 113 can be formed smaller.

Further, although the partition plate 13 is formed integrally with the housing 10 in the embodiments, it is not necessarily so. For example, the partition plate 13 may be formed detachably as a member that is separate from the upper cover 101 and the lower cabinet 102. In this case, by changing the partition plate 13, users can easily adjust the quality of sound to reproduce from the speaker structure 1.

Also, the position, the size or the like of the second opening portion 22 of the port is not limited to those illustrated in the embodiments, but can be modified. For example, the position of the second opening portion 22 may be moved in the front-rear direction, that is, along Y direction. This allows adjustments of the quality of sound to reproduce from the speaker structure 1.

Moreover, although the first opening portion 21 of the port 20 is open to outside in a side face of the housing 10, it may not be limited as such, but be open to outside in a rear face of the housing 10, for example. The sound emitted out of the port 20 is low frequency components having low directivity. Therefore, no matter which direction the sound emission occurs from, there is no problem. Besides, since the first opening portion 21 is formed at a position that is difficult to be viewed by users, a degree of freedom in designing the speaker structure 1 increases.

Still, although a passive speaker is illustrated in the embodiments, the present invention is not limited to passive speakers, but is also applicable to, for example, an active speaker with built-in amplifier. Also, the present invention may be applied to an integrated speaker with a communication function such as Bluetooth (Registered Trademark), Wi-Fi (Registered Trademark). The present invention may be applied to an speaker with a digital sound signal reproduction function. The present invention may be applied to an speaker with a sound signal amplification or adjustment function or the like.

Lastly, the foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A speaker structure comprising:
a first enclosure;
a second enclosure;
a partition plate arranged between the first enclosure and the second enclosure, the partition plate including at least one communication hole configured to allow the first enclosure and the second enclosure to communicate with each other; and
a bass reflex port in fluid communication with one or both of the first enclosure and the second enclosure,
wherein the bass reflex port extends across the first enclosure and the second enclosure.

2. The speaker structure according to claim 1, wherein
the bass reflex port is located on a side of the speaker structure away from a front speaker side.

3. The speaker structure according to claim 1, wherein
the base reflex port is located at a rear face side of the first enclosure and the second enclosure, the rear face side being located opposite from a front speaker side of the first enclosure and the second enclosure.

4. The speaker structure according to claim 1, wherein
the bass reflex port has a width along an x-axis extending in a direction that crosses both of the first and second enclosures, the width being greater than a height along a z-axis and greater than a depth along a y-axis, and
the base reflex port longitudinal direction is aligned parallel to a side of the first enclosure and the second enclosure.

5. The speaker structure according to claim 4, wherein
the longitudinal axis of the bass reflex port extends along a direction in which the first enclosure and the second enclosure are arranged in a row.

6. The speaker structure according to claim 1, wherein
a middle region along a longitudinal length of the bass reflex port includes a bent portion.

7. The speaker structure according to claim 6, wherein
the bass reflex port is disposed along an inner wall face of one or both of the first enclosure and the second enclosure.

8. The speaker structure according to claim 1, wherein
the bass reflex port is a one-piece component.

9. The speaker structure according to claim 1, wherein
a wall in one or both of the first enclosure and the second enclosure faces the at least one communication hole.

10. The speaker structure according to claim 9, wherein
the wall protrudes from an inner wall of one or both of the first enclosure and the second enclosure.

11. A speaker structure comprising:
a first enclosure;
a second enclosure;
a partition plate arranged between the first enclosure and the second enclosure, the partition plate including at least one communication hole configured to allow the first enclosure and the second enclosure to communicate with each other; and
a bass reflex port in fluid communication with one or both of the first enclosure and the second enclosure, wherein
a wall in one or both of the first enclosure and the second enclosure faces the at least one communication hole,
the wall protrudes from an inner wall of one or both of the first enclosure and the second enclosure, and
the wall protrudes from the partition plate.

12. The speaker structure according to claim 11, wherein
the wall protrudes from a plurality of portions of the partition plate.

13. A speaker structure comprising:
a first enclosure;
a second enclosure;
a partition plate arranged between the first enclosure and the second enclosure, the partition plate including at least one communication hole configured to allow the first enclosure and the second enclosure to communicate with each other; and
a bass reflex port in fluid communication with one or both of the first enclosure and the second enclosure, wherein
a wall in one or both of the first enclosure and the second enclosure faces the at least one communication hole, and
a sound absorbing material is disposed between the wall and the at least one communication hole.

14. The speaker structure according to claim 1, wherein
the at least one communication hole is formed in a middle of the partition plate.

15. The speaker structure according to claim 1, wherein
at least portions of the first enclosure, the second enclosure and the partition plate are formed integrally.

16. The speaker structure according to claim 1, comprising:
the at least one communication hole is a plurality of communication holes.

17. The speaker structure according to claim 11, wherein
the at least one communication hole is formed in a middle of the partition plate.

18. The speaker structure according to claim 11, wherein
at least portions of the first enclosure, the second enclosure and the partition plate are formed integrally.

19. The speaker structure according to claim 1, comprising:
the at least one communication hole is a plurality of communication holes.

* * * * *